US008500955B2

(12) United States Patent
Hermans et al.

(10) Patent No.: US 8,500,955 B2
(45) Date of Patent: Aug. 6, 2013

(54) TISSUE SHEETS HAVING ENHANCED CROSS-DIRECTION PROPERTIES

(75) Inventors: Michael Alan Hermans, Neenah, WI (US); Rachel Allison Graff, Tulsa, OK (US); Samuel August Nelson, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 13/335,118

(22) Filed: Dec. 22, 2011

(65) Prior Publication Data

US 2013/0160960 A1 Jun. 27, 2013

(51) Int. Cl.
*D21H 11/00* (2006.01)

(52) U.S. Cl.
USPC ..... 162/109; 162/205; 162/123

(58) Field of Classification Search
USPC ..... 162/109, 205, 110, 111, 117, 123–133; 428/152, 153
See application file for complete search history.

(56) References Cited

U.S. PATENT DOCUMENTS

| | | | |
|---|---|---|---|
| 5,286,348 | A | 2/1994 | Perin |
| 5,470,436 | A | 11/1995 | Wagle et al. |
| 7,300,543 | B2 | 11/2007 | Mullally et al. |
| 2004/0206465 | A1 | 10/2004 | Farrington et al. |
| 2007/0131366 | A1 | 6/2007 | Underhill et al. |

*Primary Examiner* — Mark Halpern
(74) *Attorney, Agent, or Firm* — Michael J. Sullivan

(57) ABSTRACT

The present disclosure provides tissue webs with improved durability produced by rewetting a dried tissue web, pressing the rewetted web and drying the web for a second time. This improved durability is manifested by a high cross-machine direction (CD) slope.

15 Claims, 4 Drawing Sheets

TISSUE SHEETS HAVING ENHANCED CROSS-DIRECTION PROPERTIES

BACKGROUND

Generally papermakers, particularly manufacturers of low basis weight tissue webs, have attempted to reduce the machine and cross direction slopes at a given tensile strength. For example, U.S. Pat. No. 7,972,474 to Underhill discloses tissues with enhanced cross-machine direction properties including relatively high peak stretch, relatively low slope, and increased tensile energy absorbed. Underhill reported that tissue products having these properties have relatively low stiffness with increased extensibility at relatively high strength levels. Generally, the products produced in Underhill had a cross-machine direction slope (CD slope) of roughly 2,000 to 3,000 grams per 3 inches. Underhill hypothesized that low CD slope correlates to a low bending stiffness, yielding a soft tissue.

In addition to Underhill's teachings, papermakers have attempted to reduce CD slope by reducing the CD tensile strength or by increasing CD stretch at a given CD tensile. However as increased CD stretch levels have become practical due to advances in fabric technology, CD slope values have become even lower, and at some point a low CD slope may be interpreted as indicative of a weak or "flimsy" tissue. Thus, in some instances it may be desirable for the papermaker to increase CD slope.

One example of increasing the CD slope of a tissue web is provided in U.S. Pat. No. 7,300,543 to Mullally. To increase the CD slope of the tissue web Mullally utilized papermaking fabrics with deep discontinuous pockets in an uncreped throughdried tissue process. While the webs of Mullally had increased CD slope, such CD slope values that may not be sufficient to provide a tissue with desired levels of attributes such as substance in hand at the appropriate CD tensile level. Furthermore, a product with deep discontinuous pockets may not be desired by consumers. Therefore, there remains a need in the art for tissue webs having increased CD slope as well as methods of manufacturing the same.

SUMMARY

It has now been discovered that tissue webs with improved durability and softness can be produced by rewetting a dried tissue web, pressing the rewetted web and drying the web for a second time. This improved durability/softness relationship is manifested by a high cross-direction slope (CD slope), which is the slope of the cross-machine direction load versus elongation curve for the tissue. The high CD slope, particularly at a given level of CD tensile and CD stretch, gives rise to products that tend to be perceived by the consumer as durable. Further, a high CD slope means that the beneficial CD stretch is not easily removed from the tissue when the product is used by the consumer. Thus, tissue products with a high CD slope will resist having the CD stretch removed when subjected to a tensile load in the CD. The CD properties are particularly important because tissue webs are usually relatively weak and fail in this direction due to the orientation of the fibers primarily in the machine direction (MD). Hence increasing the CD slope is highly desirable in terms of providing an unusually durable tissue. While the CD slope alone can be increased by increasing the CD tensile strength, this is not preferred as it tends to make the tissue stiffer and hence less soft in the eyes of the consumer. Therefore a proper combination of CD tensile strength and CD slope has been determined to be highly desirable for providing consumer-preferred tissue products.

Hence, in one aspect the present disclosure provides a tissue web having a CD tensile of less than about 1,500 grams per 3 inches, a CD stretch greater than about 12 percent and a CD slope greater than about 9,000 grams per 3 inches.

In other aspects, the present disclosure provides a tissue web having a ratio of CD tensile to CD slope of greater than about 10 and a CD stretch greater than about 10 percent.

In another aspect, the present disclosure provides a method of making a tissue sheet comprising: (a) forming a throughdried tissue web having a moisture content of less than about 5 percent, (b) rewetting the web, (c) pressing the rewetted web, and (d) drying the pressed web, such that the web has a moisture content less than about 5 percent.

DEFINITIONS

Figure 1:
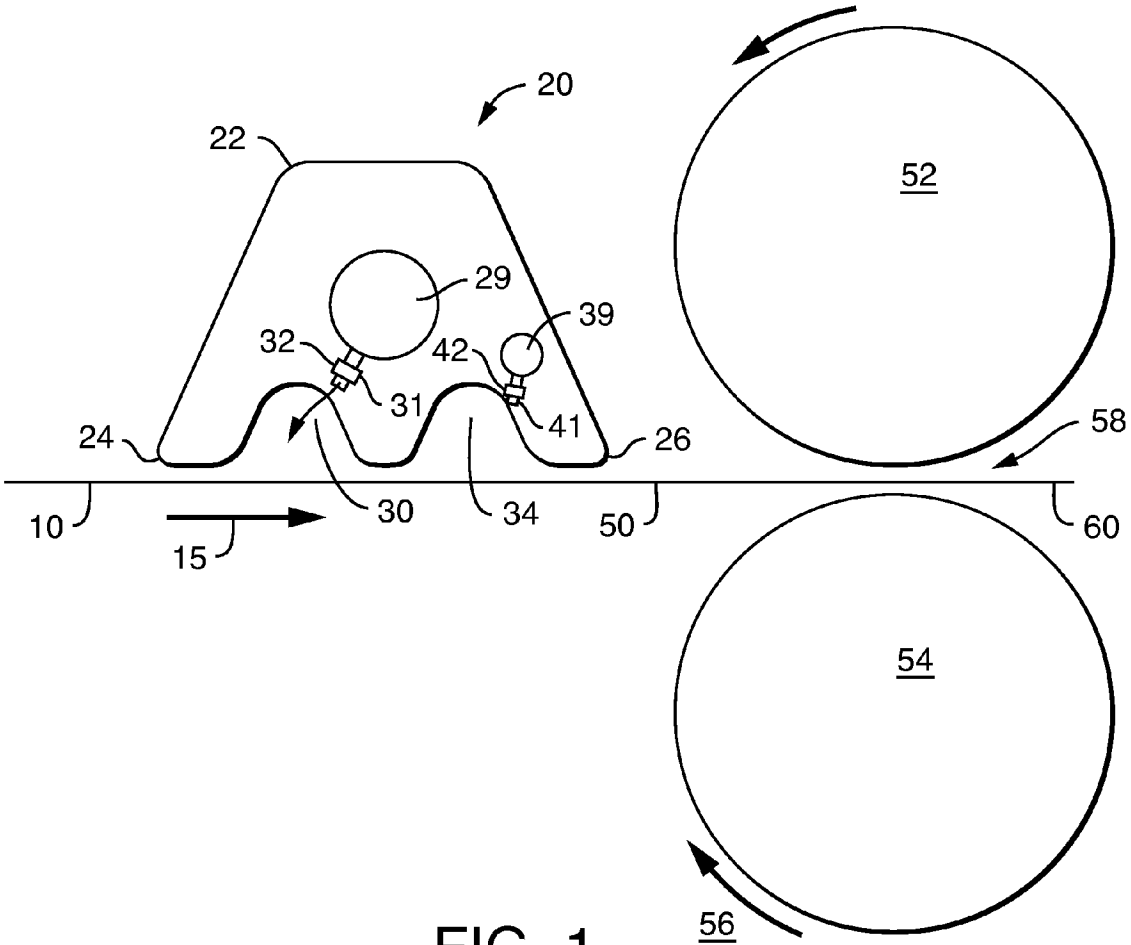
FIG. 1 is an illustration of one embodiment for rewetting, pressing and drying a tissue web according to the present invention.

The terms "tensile strength," "MD Tensile," and "CD Tensile," generally refer to the maximum stress that a material can withstand while being stretched or pulled in any given orientation as measured using a crosshead speed of 254 millimeters per minute, a full scale load of 4,540 grams, a jaw span (gauge length) of 50.8 millimeters and a specimen width of 762 millimeters. The MD tensile strength is the peak load per 3 inches of sample width when a sample is pulled to rupture in the machine direction. Similarly, the CD tensile strength represents the peak load per 3 inches of sample width when a sample is pulled to rupture in the cross-machine direction. For 1-ply products each tensile strength measurement is done on 1-ply. For multiple ply products tensile testing is done on the number of plies expected in the finished product. For example, 2-ply products are tested two plies at one time and the recorded MD and CD tensile strengths are the strengths of both plies.

Samples for tensile strength testing are prepared by cutting a 3 inches (76.2 mm)×5 inches (127 mm) long strip in either the machine direction (MD) or cross-machine direction (CD) orientation using a JDC Precision Sample Cutter (Thwing-Albert Instrument Company, Philadelphia, Pa., Model No. JDC 3-10, Ser. No. 37333). The instrument used for measuring tensile strengths is an MTS Systems Sintech 11S, Serial No. 6233. The data acquisition software is MTS TestWorks™ for Windows Ver. 3.10 (MTS Systems Corp., Research Triangle Park, NC). The load cell is selected from either a 50 Newton or 100 Newton maximum, depending on the strength of the sample being tested, such that the majority of peak load values fall between 10 and 90 percent of the load cell's full scale value. The gauge length between jaws is 2±0.04 inches (50.8±1 mm). The jaws are operated using pneumatic-action and are rubber coated. The minimum grip face width is 3 inches (76.2 mm), and the approximate height of a jaw is 0.5 inches (12.7 mm). The crosshead speed is 10±0.4 inches/min (254+1 mm/min), and the break sensitivity is set at 65 percent. The sample is placed in the jaws of the instrument, centered both vertically and horizontally. The test is then started and ends when the specimen breaks. The peak load is recorded as either the "MD tensile strength" or the "CD tensile strength" of the specimen depending on the sample being tested. At least six (6) representative specimens are tested for each product, taken "as is," and the arithmetic average of all individual specimen tests is either the MD or CD tensile strength for the product.

The term "Tensile Energy Absorbed" (abbreviated "TEA") generally refers to the area under the stress-strain curve during the same tensile test as described above. The area is based on the strain value reached when the sheet is strained to rupture and the load placed on the sheet has dropped to 65 percent of the peak tensile load. Since the thickness of a paper sheet is generally unknown and varies during the test, it is common practice to ignore the cross-sectional area of the sheet and report the "stress" on the sheet as a load per unit length or typically in the units of grams per 3 inches of width. For the TEA calculation, the stress is converted to grams per centimeter and the area calculated by integration. The units of strain are centimeters per centimeter so that the final TEA units become g-cm/cm$^2$.

The terms "Stretch," "MD Stretch," and "CD Stretch," generally refer to the ratio of the slack-corrected elongation of a specimen at the point it generates its peak load divided by the slack-corrected gauge length in any given orientation. Stretch is an output of the MTS TestWorks™ in the course of determining the tensile strength as described above. Stretch is reported as a percentage.

The term "CD slope" generally refers to slope of the line resulting from plotting CD Tensile versus CD Stretch and is an output of the MTS TestWorks™ in the course of determining the tensile strength as described above. Slope is reported in the units of grams (g) per unit of sample width (inches) and is measured as the gradient of the least-squares line fitted to the load-corrected strain points falling between a specimen-generated force of 70 to 157 grams (0.687 to 1.540 N) divided by the specimen width.

As used herein, the sheet "caliper" is the representative thickness of a single sheet measured in accordance with TAPPI test methods T402 "Standard Conditioning and Testing Atmosphere For Paper, Board, Pulp Handsheets and Related Products" and T411om-89 "Thickness (caliper) of Paper, Paperboard, and Combined Board" with Note 3 for stacked sheets. The micrometer used for carrying out T411 om-89 is an Emveco 200-A Tissue Caliper Tester (Emveco, Inc., Newberg, Oreg.). The micrometer has a load of 2 kilo-Pascals, a pressure foot area of 2500 square millimeters, a pressure foot diameter of 56.42 millimeters, a dwell time of 3 seconds and a lowering rate of 0.8 millimeters per second.

As used herein, the sheet "bulk" is calculated as the quotient of the "caliper", expressed in microns, divided by the dry basis weight, expressed in grams per square meter. The resulting sheet bulk is expressed in cubic centimeters per gram.

As used herein, the term "sheet moisture" generally refers to the average sheet moisture for a 10 foot sheet segment of tissue web. Sheet moisture is determined by weighing the moisture-containing sheet and comparing the weight of this sheet to the weight of the sheet after drying the sheet in an oven until the moisture has been removed. A suitable test method for determining sheet moisture is TAPPI Test T-210 cm-93.

DETAILED DESCRIPTION

It has now been surprisingly discovered that a tissue web having enhanced cross machine (CD) properties, such as CD slope and CD stretch, may be produced by subjecting a dried tissue web to rewetting, pressing and drying for a second time. For example, in one embodiment, a tissue web may be produced according to methods known in the art, such as those disclosed in U.S. Pat. No. 5,772,845, to yield an uncreped throughair dried ("UCTAD") tissue web having a basis weight of from about 15 to about 60 grams per square meter (gsm) and a moisture content from about 0.5 to about 5 percent. The dried tissue web is then subjected to rewetting such that the moisture content is increased to at least about 10 percent, preferably from about 15 to about 50 percent. The rewetted tissue web is then subjected to pressing, preferably at a pressure of at least about 1,000 pounds per square inch (psi), such as from about 2000 to about 10,000 psi. After pressing, the rewetted and pressed tissue web is dried a second time to yield a tissue web having a moisture content from about 0.5 to about 5 percent, and more preferably from about 1 to about 3 percent. The resulting tissue web has improved CD properties.

Accordingly, in certain embodiments, the rewetted and pressed tissue web may have a CD stretch greater than about 10 percent, more specifically from about 12 to about 25 percent, more specifically from about 12 to about 20 percent, more specifically from about 12 to about 18 percent.

The CD slope of the tissue webs of this invention, which is indicative of the softness or stiffness of the sheet, can be from about 9,000 to about 18,000 grams per 3 inches, more specifically from about 10,000 to about 16,000 grams per 3 inches, and still more specifically from about 12,000 to about 14,000 grams per 3 inches. Preferably the CD slope is achieved in tissue webs having a CD tensile of less than about 1,500 grams per 3 inches, and more preferably from about 800 to about 1,000 grams per 3 inches. As noted previously, CD slope may be increased by increase CD Tensile, but with negative effect on stiffness and softness. Therefore, one of the objectives of the present invention is to provide a tissue web having a relatively modest CD Tensile, preserving the softness of the web, but with an elevated CD slope.

The CD TEA of the tissue webs of the present disclosure, which is indicative of the overall durability of a tissue sheet, can be about 8 grams-centimeter per square centimeter (g-cm/cm$^2$) or greater, more specifically from about 8 to about 16 g-cm/cm$^2$, and more specifically from about 10 to about 14 g-cm/cm$^2$.

In other embodiments the tissue webs of the present disclosure have a novel combination of both CD stretch and CD slope at a given CD tensile. For example, preferably the tissue webs have a CD tensile of less than about 1,500 grams per 3 inches, a CD stretch greater than about 12 percent, and a CD slope greater than about 9,000 grams per 3 inches.

This increase in CD slope at a particular level of CD tensile and CD stretch is an improvement over prior art tissues, which have typically attempted to reduce CD slope at a given CD tensile. A comparison of tissue webs produced according to the present disclosure and prior art webs is provided below.

TABLE 1

| Sample | Plies | CD slope (g/3") | CD Tensile (g/3") | CD slope: CD Tensile | CD Stretch (%) |
|---|---|---|---|---|---|
| Code 616-7 (Inventive) | 1 | 9328 | 867 | 10.75 | 13.2 |
| Code 623-7 (Inventive) | 1 | 11945 | 1086 | 11.00 | 15.78 |
| Cottonelle ® Ultra | 1 | 3135 | 705 | 4.44 | 15.38 |
| Cottonelle ® | 1 | 4581 | 600 | 7.63 | 10.6 |

TABLE 1-continued

| Sample | Plies | CD slope (g/3") | CD Tensile (g/3") | CD slope: CD Tensile | CD Stretch (%) |
|---|---|---|---|---|---|
| Scott ® 1000 | 1 | 14856 | 572 | 25.19 | 5.4 |
| Quilted Northern ® Soft &Strong | 2 | 12245 | 528 | 23.19 | 5.9 |
| Charmin ® Ultra Strong | 2 | 7017 | 855 | 8.20 | 11.61 |

Tissue webs made in accordance with the present disclosure can be made with a homogeneous fiber furnish or can be formed from a stratified fiber furnish producing layers within the single- or multi-ply product. Stratified base webs can be formed using equipment known in the art, such as a multi-layered headbox. Both strength and softness of the base web can be adjusted as desired through layered tissues, such as those produced from stratified headboxes.

For instance, different fiber furnishes can be used in each layer in order to create a layer with the desired characteristics. For example, layers containing softwood fibers have higher tensile strengths than layers containing hardwood fibers. Hardwood fibers, on the other hand, can increase the softness of the web. In one embodiment, the single ply base web of the present disclosure includes a first outer layer and a second outer layer containing primarily hardwood fibers. The hardwood fibers can be mixed, if desired, with paper broke in an amount up to about 10 percent by weight and/or softwood fibers in an amount up to about 10 percent by weight. The base web further includes a middle layer positioned in between the first outer layer and the second outer layer. The middle layer can contain primarily softwood fibers. If desired, other fibers, such as high-yield fibers or synthetic fibers may be mixed with the softwood fibers in an amount up to about 10 percent by weight.

When constructing a web from a stratified fiber furnish, the relative weight of each layer can vary depending upon the particular application. For example, in one embodiment, when constructing a web containing three layers, each layer can be from about 15 to about 40 percent of the total weight of the web, such as from about 25 to about 35 percent of the weight of the web.

Wet strength resins may be added to the furnish as desired to increase the wet strength of the final product. Presently, the most commonly used wet strength resins belong to the class of polymers termed polyamide-polyamine epichlorohydrin resins. There are many commercial suppliers of these types of resins including Hercules, Inc. (Kymene™) Henkel Corp. (Fibrabond™), Borden Chemical (Cascamide™), Georgia-Pacific Corp. and others. These polymers are characterized by having a polyamide backbone containing reactive crosslinking groups distributed along the backbone. Other useful wet strength agents are marketed by American Cyanamid under the Parez™ trade name.

Similarly, dry strength resins can be added to the furnish as desired to increase the dry strength of the final product. Such dry strength resins include, but are not limited to carboxymethyl celluloses (CMC), any type of starch, starch derivatives, gums, polyacrylamide resins, and others as are well known. Commercial suppliers of such resins are the same those that supply the wet strength resins discussed above.

Another strength chemical that can be added to the furnish is Baystrength 3000 available from Kemira (Atlanta, Ga.), which is a glyoxalated cationic polyacrylamide used for imparting dry and temporary wet tensile strength to tissue webs.

As described above, the tissue product of the present disclosure can generally be formed by any of a variety of papermaking processes known in the art. Preferably the tissue web is formed by through-air drying and may be either creped or uncreped. For example, a papermaking process of the present disclosure can utilize adhesive creping, wet creping, double creping, embossing, wet-pressing, air pressing, through-air drying, creped through-air drying, uncreped through-air drying, as well as other steps in forming the paper web. Some examples of such techniques are disclosed in U.S. Pat. Nos. 5,048,589, 5,399,412, 5,129,988 and 5,494,554, all of which are incorporated herein in a manner consistent with the present disclosure. When forming multi-ply tissue products, the separate plies can be made from the same process or from different processes as desired.

For example, in one embodiment, tissue webs may be creped through-air dried webs formed using processes known in the art. To form such webs, an endless traveling forming fabric, suitably supported and driven by rolls, receives the layered papermaking stock issuing from the headbox. A vacuum box is disposed beneath the forming fabric and is adapted to remove water from the fiber furnish to assist in forming a web. From forming fabric, a formed web is transferred to a second fabric, which may be either a wire or a felt. The fabric is supported for movement around a continuous path by a plurality of guide rolls. A pick up roll designed to facilitate transfer of web from fabric to fabric may be included to transfer the web.

Preferably the formed web is dried by transfer to the surface of a rotatable heated dryer drum, such as a Yankee dryer. The web may be transferred to the Yankee directly from the throughdrying fabric, or preferably, transferred to an impression fabric which is then used to transfer the web to the Yankee dryer. In accordance with the present disclosure, the creping composition of the present disclosure may be applied topically to the tissue web while the web is traveling on the fabric or may be applied to the surface of the dryer drum for transfer onto one side of the tissue web. In this manner, the creping composition is used to adhere the tissue web to the dryer drum. In this embodiment, as the web is carried through a portion of the rotational path of the dryer surface, heat is imparted to the web causing most of the moisture contained within the web to be evaporated. The web is then removed from dryer drum by a creping blade. The creping web as it is formed further reduces internal bonding within the web and increases softness. Applying the creping composition to the web during creping, on the other hand, may increase the strength of the web.

In another embodiment the formed web is transferred to the surface of the rotatable heated dryer drum, which may be a Yankee dryer. The press roll may, in one embodiment, comprise a suction pressure roll. In order to adhere the web to the surface of the dryer drum, a creping adhesive may be applied to the surface of the dryer drum by a spraying device. The spraying device may emit a creping composition made in accordance with the present disclosure or may emit a conventional creping adhesive. The web is adhered to the surface of the dryer drum and then creped from the drum using the creping blade. If desired, the dryer drum may be associated with a hood. The hood may be used to force air against or through the web. Once creped from the dryer drum, the web may, optionally, be fed around a cooling reel drum and cooled prior to being wound on a reel.

In addition to applying the creping composition during formation of the fibrous web, the creping composition may also be used in post-forming processes. For example, in one aspect, the creping composition may be used during a print-creping process. Specifically, once topically applied to a fibrous web, the creping composition has been found well-suited to adhering the fibrous web to a creping surface, such as in a print-creping operation.

For example, once a fibrous web is formed and dried the creping composition may be applied to at least one side of the web and the at least one side of the web may then be creped. In general, the creping composition may be applied to only one side of the web and only one side of the web may be creped, the creping composition may be applied to both sides of the web and only one side of the web is creped, or the creping composition may be applied to each side of the web and each side of the web may be creped.

Once creped the tissue web may be pulled through a drying station. The drying station can include any form of a heating unit, such as an oven energized by infra-red heat, microwave energy, hot air or the like. A drying station may be necessary in some applications to dry the web and/or cure the creping composition. Depending upon the creping composition selected, however, a drying station may not be needed.

In other embodiments, the base web is formed by an uncreped through-air drying process as described for example, in U.S. Pat. Nos. 5,656,132 and 6,017,417, both of which are hereby incorporated by reference herein in a manner consistent with the present disclosure. A twin wire former having a papermaking headbox injects or deposits a furnish of an aqueous suspension of papermaking fibers onto a plurality of forming fabrics, such as the outer forming fabric and the inner forming fabric, thereby forming a wet tissue web. The forming process of the present disclosure may be any conventional forming process known in the papermaking industry. Such formation processes include, but are not limited to, Fourdriniers, roof formers such as suction breast roll formers, and gap formers such as twin wire formers and crescent formers.

The wet tissue web forms on the inner forming fabric as the inner forming fabric revolves about a forming roll. The inner forming fabric serves to support and carry the newly-formed wet tissue web downstream in the process as the wet tissue web is partially dewatered. Additional dewatering of the wet tissue web may be carried out by known paper making techniques, such as vacuum suction boxes, while the inner forming fabric supports the wet tissue web. The wet tissue web may be additionally dewatered to a consistency of at least about 20 percent, more specifically between about 20 to about 40 percent, and more specifically about 20 to about 30 percent.

The forming fabric can generally be made from any suitable porous material, such as metal wires or polymeric filaments. For instance, some suitable fabrics can include, but are not limited to, Albany 84M and 94M available from Albany International (Albany, N.Y.) Asten 856, 866, 867, 892, 934, 939, 959, or 937; Asten Synweve Design 274, all of which are available from Asten Forming Fabrics, Inc. (Appleton, Wis.); and Voith 2164 available from Voith Fabrics (Appleton, Wis.). Forming fabrics or felts comprising nonwoven base layers may also be useful, including those of Scapa Corporation made with extruded polyurethane foam such as the Spectra Series.

The wet web is then transferred from the forming fabric to a transfer fabric while at a solids consistency of between about 10 to about 35 percent, and particularly, between about 20 to about 30 percent. As used herein, a "transfer fabric" is a fabric that is positioned between the forming section and the drying section of the web manufacturing process.

Transfer to the transfer fabric may be carried out with the assistance of positive and/or negative pressure. For example, in one embodiment, a vacuum shoe can apply negative pressure such that the forming fabric and the transfer fabric simultaneously converge and diverge at the leading edge of the vacuum slot. Typically, the vacuum shoe supplies pressure at levels between about 10 to about 25 inches of mercury. As stated above, the vacuum transfer shoe (negative pressure) can be supplemented or replaced by the use of positive pressure from the opposite side of the web to blow the web onto the next fabric. In some embodiments, other vacuum shoes can also be used to assist in drawing the fibrous web onto the surface of the transfer fabric.

Typically, the transfer fabric travels at a slower speed than the forming fabric to enhance the MD and CD stretch of the web, which generally refers to the stretch of a web in its cross or machine direction (expressed as percent elongation at sample failure). For example, the relative speed difference between the two fabrics can be from about 1 to about 30 percent, in some embodiments from about 5 to about 20 percent, and in some embodiments, from about 10 to about 15 percent. This is commonly referred to as "rush transfer." During "rush transfer," many of the bonds of the web are believed to be broken, thereby forcing the sheet to bend and fold into the depressions on the surface of the transfer fabric. Such molding to the contours of the surface of the transfer fabric may increase the MD and CD stretch of the web. Rush transfer from one fabric to another can follow the principles taught in any one of the following patents, U.S. Pat. Nos. 5,667,636, 5,830,321, 4,440,597, 4,551,199, 4,849,054, all of which are hereby incorporated by reference herein in a manner consistent with the present disclosure.

The wet tissue web is then transferred from the transfer fabric to a throughdrying fabric. Typically, the transfer fabric travels at approximately the same speed as the throughdrying fabric. However, in certain embodiments, a second rush transfer may be performed as the web is transferred from the transfer fabric to a throughdrying fabric. This rush transfer is referred to herein as occurring at the second position and is achieved by operating the throughdrying fabric at a slower speed than the transfer fabric. By performing rush transfer at two distinct locations, i.e., the first and the second positions, a tissue product having increased CD stretch may be produced.

In addition to rush transferring the wet tissue web from the transfer fabric to the throughdrying fabric, the wet tissue web may be macroscopically rearranged to conform to the surface of the throughdrying fabric with the aid of a vacuum transfer roll or a vacuum transfer shoe like vacuum shoe. If desired, the throughdrying fabric can be run at a speed slower than the speed of the transfer fabric to further enhance stretch of the resulting tissue product. The transfer may be carried out with vacuum assistance to ensure conformation of the wet tissue web to the topography of the throughdrying fabric.

In a particularly preferred embodiment, the web is transferred to the throughdrying fabric for final drying preferably with the assistance of vacuum to ensure macroscopic rearrangement of the web to give the desired bulk and appearance. The use of separate transfer and throughdrying fabrics can offer various advantages since it allows the two fabrics to be designed specifically to address key product requirements independently. For example, the transfer fabrics are generally optimized to allow efficient conversion of high rush transfer levels to high MD stretch while throughdrying fabrics are designed to deliver bulk and CD stretch. It is therefore useful to have moderately coarse and moderately three-dimensional transfer fabrics and throughdrying fabrics which are quite coarse and three-dimensional in the optimized configuration. The result is that a relatively smooth sheet leaves the transfer section and then is macroscopically rearranged (with vacuum assist) to give the high bulk, high CD stretch surface topology of the throughdrying fabric. Sheet topology is completely changed from transfer to throughdrying fabric and fibers are macroscopically rearranged, including significant fiber-fiber movement.

The drying process can be any noncompressive drying method which tends to preserve the bulk or thickness of the wet web including, without limitation, throughdrying, infrared radiation, microwave drying, etc. Because of its commercial availability and practicality, throughdrying is well known and is one commonly used means for noncompressively drying the web for purposes of this invention. Suitable throughdrying fabrics include, without limitation, fabrics with substantially continuous machine direction ridges whereby the ridges are made up of multiple warp strands grouped together, such as those disclosed in U.S. Pat. No. 6,998,024. Other suitable throughdrying fabrics include those disclosed in U.S. Pat. No. 7,611,607, which is incorporated herein in a manner consistent with the present disclosure, particularly the fabrics denoted as Fred (t1207-7), Jetson (t1207-6) and Jack (t1207-12). The web is preferably dried to final dryness on the throughdrying fabric, without being pressed against the surface of a Yankee dryer, and without subsequent creping.

To further increase the CD properties of the web, specifically the CD slope, the dried tissue web may be rewetted, pressed and dried a second time as illustrated in FIG. 1. As shown in FIG. 1, the dried tissue web 10 (travelling in the direction indicated by arrow 15) is rewetted (also referred to herein as moisturized) using one or more moisturizing showers 20 on one or both (not shown) sides of the web. The moisturizing showers may consist of water showers (e.g., hydraulic, air atomized or ultrasonic showers) or steam showers or combination of water showers and steam showers. This rewetting of the web may be performed by a liquid, water emulsion, liquid mixture, dispersion, water sprays, steam, or other means known in the art, such that the moisture content of the web is raised (measured after the rewetting device 20 and before the pressing apparatus 52, 54) to a level of about 10 to 50 percent, most preferably from about 15 to about 40 percent. In accordance with this embodiment, rewetting devices 20 are placed, depending on the pressing apparatus type and the desired application, very close before the nip 58 of the pressing apparatus 54,56. The location of the rewetting device 20 is adjusted such that the imbition time after rewetting at a desired running speed before the nip 58 is less than about 2 seconds. In this description, by the imbition time is meant the time during which the rewetting has time to be effective before the effect of pressing in the nip and, in this connection, the imbition time ends when the contact of the surfaces compressed in the press nip ends, i.e. the compression pressure ceases to act during the nip effect.

In a particularly preferred embodiment the moisturizing shower comprises a steam shower 20 having a housing 22 which defines a leading 24 and trailing edge 26. Within the housing 22 is a bank of independently controlled nozzles 31 which are spaced at regular intervals in the cross direction and dispense steam into the steam chamber 30. The supply of steam is provided by a steam supply header 29 and the supply of steam to each nozzle 31 is controlled by a computer (not shown), which receives moisture level feedback from moisture detectors (not shown), e.g., gamma gauges, situated downstream of the moisturizing showers and adjusts the steam control valve 32 accordingly. The amount of moisture addition will is controlled so as to increase the moisture of the sheet to about 10 to about 50 percent. The moisture addition will be done in such a way that a uniform moisture level will be applied after the profiling is accomplished. The profiling and moisture addition can be done by a combination of one of more showers. If steam showers are used in conjunction with water showers, the preferred configuration would have the steam showers following the water showers.

In a particularly preferred embodiment the shower 20 is designed with a second chamber 34 for subsequently cooling the sheet with air. Accordingly, after steam is applied to the web, the web may be cooled by supply cooled air through a header 39 and a nozzle 41, controlled by a valve 42, to a cooling chamber 34. Thus, in a preferred embodiment the shower apparatus increases the moisture level, corrects non-uniformity and then cools the sheet to temperatures below 180° F. Cooling the web is intended to promote steam condensation and caliper preservation during pressing. The steam shower is preferably located very close to the pressing apparatus nip so that the time between the steam application and pressing is minimized Minimizing this time will preserve a gradient in moisture across the thickness of the web. In accordance with this preferred embodiment, it may be desirable to add a lubricant using the moisturizing showers prior to pressing. The lubricants sprayed can be commercially known dipersions/emulsions such as calcium stearate, polyethylene emulsion, polyglycerides and the like. The lubricant solution may be heated to prevent or reduce the cooling of the heated rolls during normal operation.

After moisturization, the rewetted web 50 is passed through a pressing apparatus, such as a pair of spaced apart rolls 52, 54 which are turning in the direction indicated by arrow 56. Although the pressing apparatus shown in FIG. 1 comprises a pair of opposing rolls 52, 54, it should be appreciated that a variety of presses may be utilized to provide a nip point through which the rewetted web travels and is subjected to pressing. As illustrated in FIG. 1, the press apparatus may comprise a pair of rolls 52 and 54 which form a nip 58 there-between. The rolls may be heated or unheated and may have a nip pressure from about 1,000 to about 10,000 psi, such as from about 1,500 to about 5,000 psi and more preferably from about 2,000 to about 4,000 psi. In the instance where the rolls are heated, input into the rolls should be sufficient to maintain a roll surface temperature of about 75 about 200° F. during pressing of the web.

The surface of the pressing apparatus may be either smooth or patterned. In those instances where the surface of the press is patterned the pattern may comprise a series of grooves disposed on each of the rolls such that the grooves are orientated perpendicular to one another at the nip. For example, the upper roll 52 may have spaced apart grooves that extend circumferentially of the roll 52, the grooves having a substantially parallel sides and a flat top and measuring from about 1 to about 3 mm in width and being spaced apart from about 1 to about 5 mm. The lower roll 54 may have apart grooves that extend axially of the roll 52, the grooves having a substantially parallel sides and a flat top and measuring from about 1 to about 3 mm in width and being spaced apart from about 1 to about 5 mm. When the circumferentially spaced apart grooves of the upper roll 52 and the axially spaced apart grooves of the lower roll 54 are brought into close proximity at the nip 58 to press the rewetted web 50 the grooves are orientated substantially perpendicular to one another.

After pressing, the web 60 preferably has a moisture content of between about 10 to about 50 percent, more preferably between about 20 to about 40 percent, such as from about 25 to about 35 percent. The rewetted and pressed web 60 is transported to a drying device for final drying of the web. The drying device may comprise a first auxiliary drying device. Such auxiliary dryers may include infrared dryers, microwave dryers, radio frequency dryers, sonic dryers, dielectric dryers, ultraviolet dryers, and combinations thereof. Using a microwave dryer in this low-moisture regime is ideal as microwave dryers selectively heat the water within the cell wall, thereby vaporizing the water, allowing more rapid removal of the water from the fiber without significantly affecting the cellulose. Alternatively, a pair of auxiliary dyers, such as a pair of infrared driers, is used in series to dry the rewetted and pressed web. (It is understood that three, four, or more primary dryers may be used in series.) The auxiliary dryer dries the rewetted and pressed tissue web to a final moisture content of about 5 percent or less, such as from about 0.5 to about 3 percent.

Once the tissue web has been dried, rewetted and dried again, it is possible to crepe the dried tissue web by transferring the dried tissue web to a dryer prior to reeling, or using alternative foreshortening methods such as microcreping.

The process of the present disclosure is well suited to forming multi-ply tissue products. The multi-ply tissue products can contain two plies, three plies, or a greater number of plies. In one particular embodiment, a two-ply rolled tissue product is formed according to the present disclosure in which both plies are manufactured using the same papermaking process, such as, for example, uncreped through-air dried. However, in other embodiments, the plies may be formed by two different processes. Generally, prior to being wound in a roll, the first ply and the second ply are attached together. Any suitable manner for laminating the webs together may be used. For example, the process includes a crimping device that causes the plies to mechanically attach together through fiber entanglement. In an alternative embodiment, however, an adhesive may be used in order to attach the plies together.

EXAMPLES

Uncreped through-air dried tissue samples were produced as described in U.S. Pat. No. 5,772,845, the disclosure of which is hereby incorporated by reference in a manner consistent with the present disclosure, on a tissue machine having a forming fabric, transfer fabric and throughdrying fabric. Single-ply tissue was produced with a target basis weight of 40 gsm using a blended furnish of 50 percent by weight northern softwood and 50 percent eucalyptus fibers. The furnish was not refined and no chemicals were added.

Figure 3:
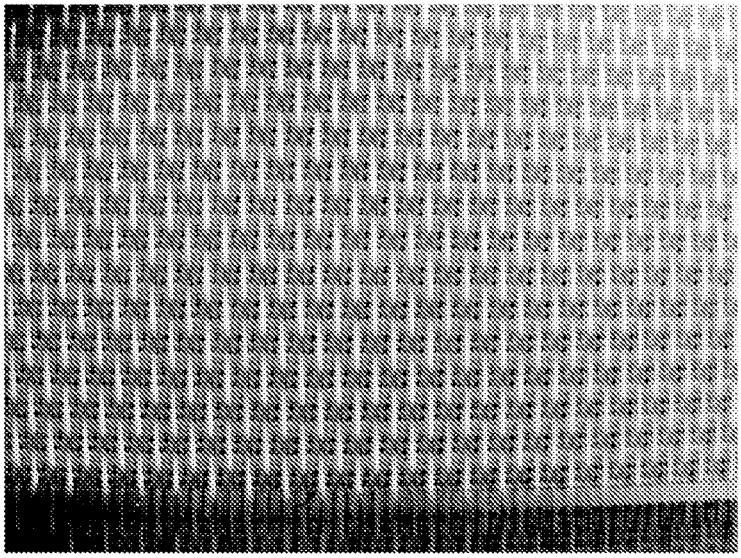
FIG. 3 is a photograph of the t-1205-2 TAD fabric provided by Voith Fabrics (Appleton, Wis.).

The total rush transfer level was varied between 28 and 60 percent, i.e., the TAD fabric was set to run at speed that was between 28 and 60 percent slower than the forming fabric. The forming fabric was a Voith 2164, the TAD fabric was either the fabric described as "Jack" in U.S. Pat. No. 7,611,607, which is incorporated herein in a manner consistent with the present disclosure, or Voith t-1205-2 (Voith Fabrics, Appleton, Wis., illustrated in FIG. 3), and the transfer fabrics were either a Voith 2164 or the fabric described as "Jetson" in U.S. Pat. No. 7,611,607. For each code, the particular rush transfer rate and fabric combination is forth in Table 2.

TABLE 2

| Code | Treatment | TAD Fabric | % Rush Transfer | Code | Treatment | TAD Fabric | % Rush Transfer |
|---|---|---|---|---|---|---|---|
| 616-C | None | Fred | 28 | 640-C | None | T1205-2 | 28 |
| 616-3 | Pressed | Fred | 28 | 640-3 | Pressed | T1205-2 | 28 |
| 616-5 | Wetted | Fred | 28 | 640-5 | Wetted | T1205-2 | 28 |
| 616-7 | Wetted/ Pressed | Fred | 28 | 640-7 | Wetted/ Pressed | T1205-2 | 28 |
| 615-C | None | Fred | 28 | 639-C | None | T1205-2 | 28 |
| 615-3 | Pressed | Fred | 28 | 639-3 | Pressed | T1205-2 | 28 |
| 615-5 | Wetted | Fred | 28 | 639-5 | Wetted | T1205-2 | 28 |
| 615-7 | Wetted/ Pressed | Fred | 28 | 639-7 | Wetted/ Pressed | T1205-2 | 28 |
| 617-C | None | Fred | 28 | 627-C | None | T1205-2 | 60 |
| 617-3 | Pressed | Fred | 28 | 627-3 | Pressed | T1205-2 | 60 |
| 617-5 | Wetted | Fred | 28 | 627-5 | Wetted | T1205-2 | 60 |
| 617-7 | Wetted/ Pressed | Fred | 28 | 627-7 | Wetted/ Pressed | T1205-2 | 60 |
| 624-C | None | Fred | 60 | 628-C | None | T1205-2 | 60 |
| 624-3 | Pressed | Fred | 60 | 628-3 | Pressed | T1205-2 | 60 |
| 624-5 | Wetted | Fred | 60 | 628-5 | Wetted | T1205-2 | 60 |
| 624-7 | Wetted/ Pressed | Fred | 60 | 628-7 | Wetted/ Pressed | T1205-2 | 60 |
| 623-C | None | Fred | 60 | | | | |
| 623-3 | Pressed | Fred | 60 | | | | |
| 623-5 | Wetted | Fred | 60 | | | | |
| 623-7 | Wetted/ Pressed | Fred | 60 | | | | |

For each sample, machine conditions and chemical additions were held constant and no effort was made to compensate for changes caused by the rush-transfer changes. Similarly, unless specified, other variables such as vacuum levels, TAD and reel settings, and pulper conditions were left constant.

Figure 2A:
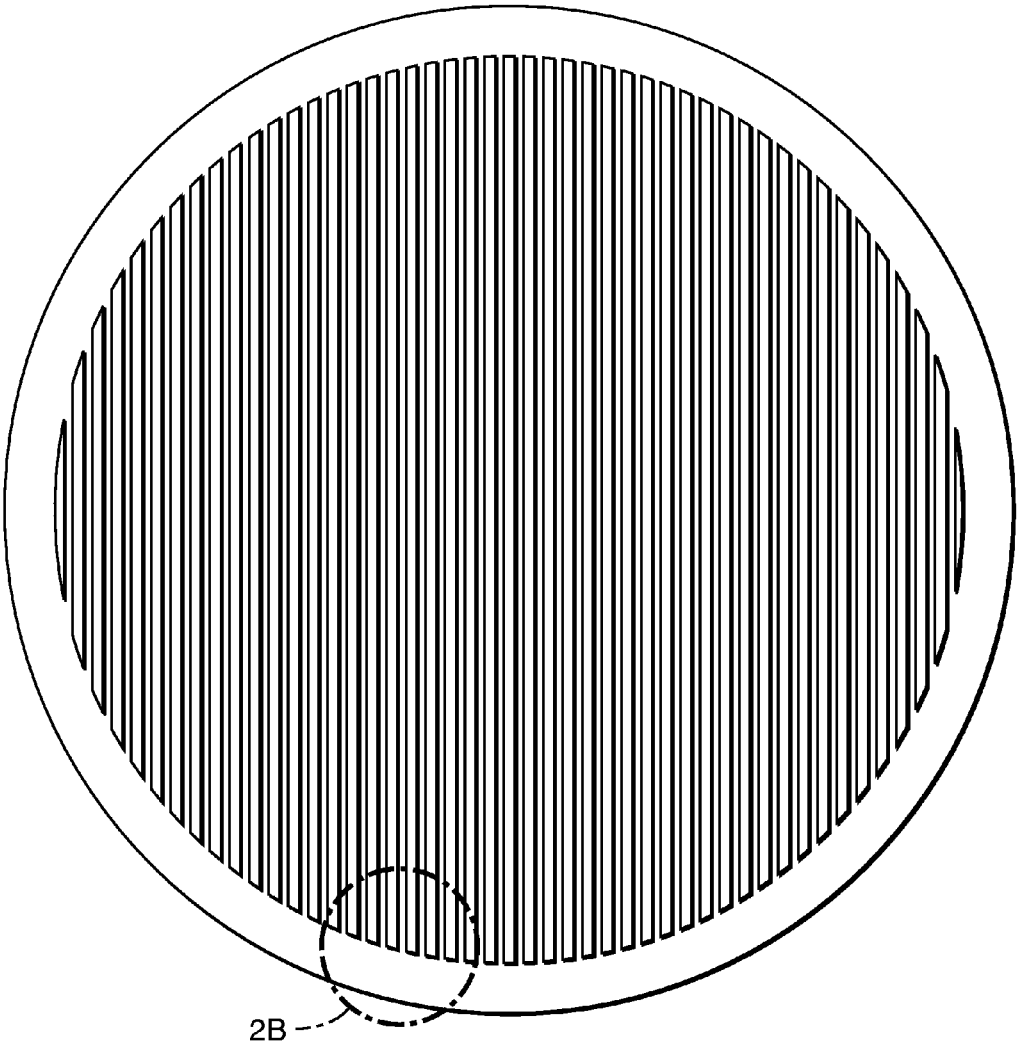
FIG. 2*a* is a top view of the press plate used to press the webs as described in the Examples and FIG. 2*b* is a detailed profile view of the same.
Figure 2B:
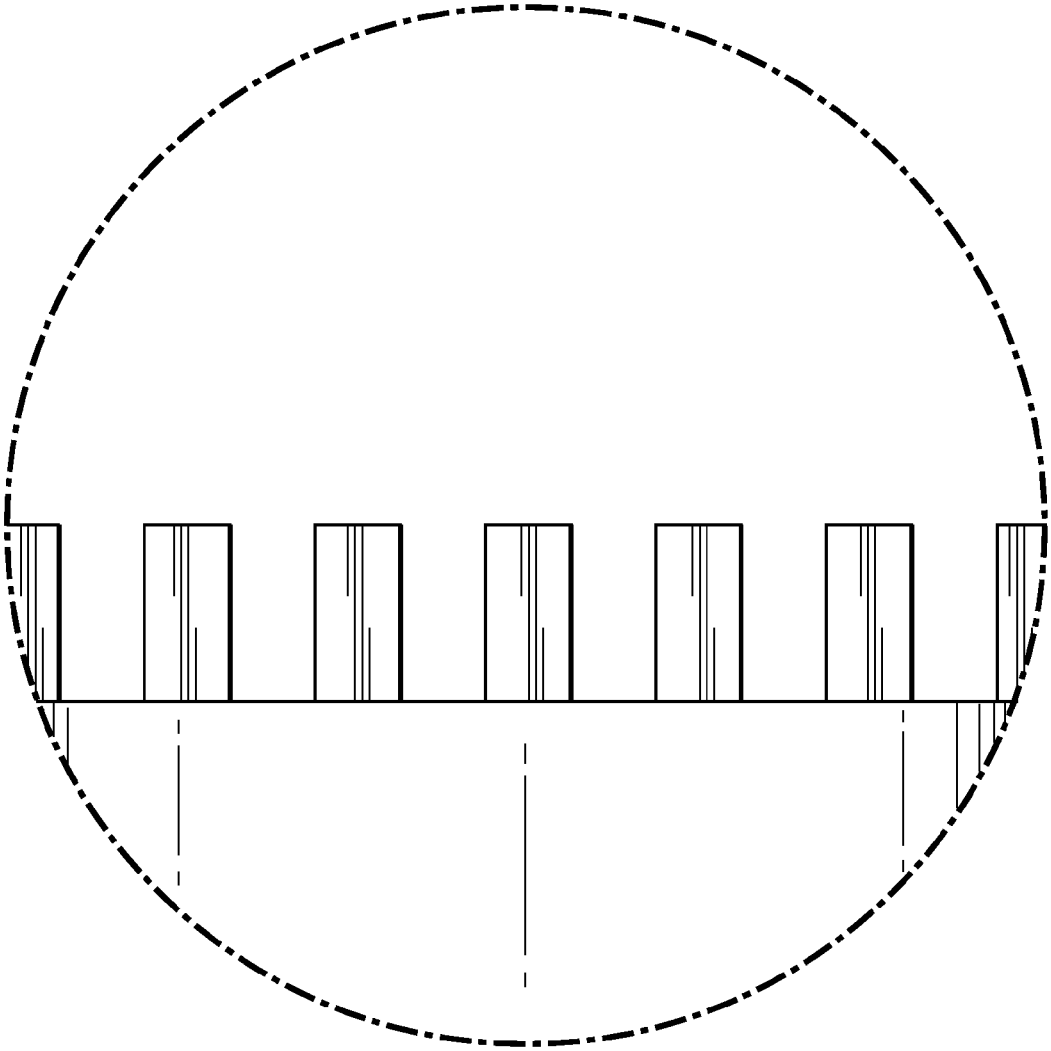

Samples to be wetted, pressed, or both wetted and pressed were cut into 3 inch by 6 inch sample sizes. The samples were then subjected to pressing, wetting, or wetting and pressing, as set forth in Table 3 below. Samples were wetted by inserting the sample between two pre-wetted press plates, illustrated in FIG. 2 (available from Kimtech, Neenah, Wis., Model #195×1-M-1163). The press plates measured approximately 10 inches in diameter and had a raised grooved surface, as illustrated in FIG. 2, having a diameter of 9 inches. More specifically, approximately 10 grams of water was added to an 11.5 inch by 11.5 inch paper towel to dampen the towel. The dampened paper towel was then wiped across the raised grooves (shown in detail in FIG. 2B, measuring approximately 2 mm high and spaced apart approximately 1 mm) on the press plates. Approximately 0.3 grams of water was applied to the surface of each press plate. The sample was then placed on top of the lower press plate and the upper press plate was lowered unto the sample so the moistened grooves of both the lower and upper plate contacted the sample. Samples remained between the wetted press plates for 30 seconds and then removed and allowed to air dry at ambient conditions.

To press the samples, samples were placed between the press plates (illustrated in FIG. 2) with the top plate aligned with the bottom plate so that the grooves on the bottom plate were perpendicular with the grooves on the top plate. The press plates were then loaded into a Carver Press (available from Carver Inc., Wabash, IN, Model No. 2518, S/N 2518-366) and subjected to 30,000 pounds of pressure by the Carver Press for 30 seconds. The load received by the samples was calculated to be approximately 3,333 psi.

Codes that were "wetted and pressed," were first wetted as described above and then pressed as described above. The wetted and pressed samples were then allowed to dry at ambient conditions.

The physical properties are summarized in Table 3, below. Control codes are denoted with a –C and inventive codes are denoted with a –7. Codes subjected only to pressing are denoted –3 and codes subjected only to wetting are denoted –5.

TABLE 3

| Sample No. | MDT (g/3") | MDS (%) | MD Slope (g/3") | MDTEA (g-cm/cm$^2$) | CDT (g/3") | CDS (%) | CD Slope (g/3") | CDTEA (g-cm/cm$^2$) | GMT (g/3") | CD Slope/ CDT |
|---|---|---|---|---|---|---|---|---|---|---|
| 616-C | 1380 | 20.48 | 12950 | 22.28 | 752 | 18.64 | 3795 | 8.83 | 1019 | 5.05 |
| 616-3 | 1149 | 17.26 | 10072 | 14.88 | 658 | 14.44 | 3380 | 6.03 | 869 | 5.14 |
| 616-5 | 1481 | 22.51 | 13601 | 25.78 | 819 | 19.35 | 4128 | 10.10 | 1101 | 5.04 |
| 616-7 | 1424 | 17.87 | 14231 | 19.83 | 867 | 13.21 | 9328 | 8.52 | 1111 | 10.75 |
| 615-C | 1734 | 22.05 | 20309 | 29.77 | 912 | 18.61 | 5344 | 10.96 | 1258 | 5.86 |
| 615-3 | 1525 | 20.53 | 12492 | 22.56 | 802 | 13.87 | 4262 | 6.90 | 1106 | 5.31 |
| 615-5 | 1754 | 23.79 | 17299 | 31.32 | 977 | 20.48 | 4429 | 12.32 | 1309 | 4.53 |
| 615-7 | 1601 | 20.66 | 13609 | 24.83 | 1172 | 14.45 | 13913 | 12.89 | 1370 | 11.87 |
| 617-C | 2096 | 23.98 | 19824 | 37.14 | 1131 | 18.38 | 5653 | 12.83 | 1539 | 5.00 |
| 617-3 | 1841 | 21.56 | 12663 | 27.78 | 1017 | 14.47 | 4923 | 8.98 | 1368 | 4.84 |
| 617-5 | 2195 | 25.39 | 16206 | 39.83 | 1288 | 21.03 | 5675 | 15.95 | 1681 | 4.41 |
| 617-7 | 2354 | 21.79 | 24315 | 38.82 | 1409 | 14.77 | 14777 | 15.42 | 1821 | 10.49 |
| 624-C | 1241 | 55.22 | 7331 | 42.92 | 776 | 20.68 | 5405 | 12.16 | 981 | 6.97 |
| 624-3 | 1091 | 49.95 | 4194 | 32.26 | 688 | 16.38 | 4592 | 8.39 | 866 | 6.67 |
| 624-5 | 1348 | 58.50 | 7037 | 47.64 | 880 | 22.42 | 6073 | 14.70 | 1089 | 6.90 |
| 624-7 | 1414 | 46.96 | 11638 | 50.43 | 967 | 13.24 | 13327 | 10.78 | 1169 | 13.78 |
| 623-C | 1529 | 57.02 | 9149 | 52.45 | 953 | 23.19 | 6453 | 16.26 | 1207 | 6.77 |
| 623-3 | 1649 | 55.05 | 4864 | 48.18 | 787 | 17.49 | 5011 | 10.06 | 1139 | 6.36 |
| 623-5 | 1648 | 61.19 | 7589 | 57.43 | 1031 | 25.15 | 6940 | 18.93 | 1303 | 6.73 |
| 623-7 | 1714 | 56.52 | 9969 | 62.56 | 1086 | 15.78 | 11945 | 13.90 | 1364 | 11.00 |
| 640-C | 1295 | 20.38 | 8261 | 18.79 | 774 | 14.64 | 4331 | 7.02 | 1001 | 5.60 |
| 640-3 | 1182 | 18.98 | 7328 | 15.02 | 682 | 11.29 | 4597 | 4.91 | 898 | 6.74 |
| 640-5 | 1315 | 20.96 | 7738 | 19.06 | 853 | 15.32 | 4147 | 7.82 | 1059 | 4.86 |
| 640-7 | 1618 | 19.29 | 18006 | 23.86 | 1015 | 9.85 | 16274 | 8.32 | 1282 | 16.03 |
| 639-C | 1675 | 23.17 | 8899 | 26.76 | 916 | 15.81 | 4513 | 8.63 | 1238 | 4.93 |
| 639-3 | 1525 | 20.94 | 8341 | 21.09 | 777 | 12.18 | 4536 | 5.85 | 1089 | 5.84 |
| 639-5 | 1829 | 25.16 | 10378 | 30.57 | 1027 | 17.06 | 4455 | 10.33 | 1370 | 4.34 |
| 639-7 | 1936 | 21.07 | 19292 | 29.66 | 1181 | 11.21 | 15404 | 10.41 | 1512 | 13.04 |
| 627-C | 1259 | 57.45 | 4737 | 40.95 | 719 | 20.58 | 3724 | 10.27 | 952 | 5.18 |
| 627-3 | 1144 | 51.42 | 2559 | 31.59 | 637 | 16.27 | 4093 | 7.57 | 854 | 6.42 |
| 627-5 | 1303 | 59.06 | 4322 | 43.35 | 785 | 21.85 | 3790 | 11.73 | 1011 | 4.83 |
| 627-7 | 1359 | 49.32 | 8666 | 48.12 | 1004 | 15.25 | 13086 | 12.83 | 1168 | 13.04 |
| 628-C | 1849 | 61.66 | 5189 | 60.83 | 968 | 20.68 | 5699 | 13.85 | 1338 | 5.89 |
| 628-3 | 1699 | 54.48 | 4306 | 47.84 | 813 | 15.84 | 5144 | 9.17 | 1175 | 6.33 |
| 628-5 | 1792 | 61.75 | 6539 | 60.20 | 1001 | 22.28 | 4358 | 14.44 | 1339 | 4.35 |
| 628-7 | 2045 | 55.62 | 14096 | 74.16 | 1141 | 15.52 | 14002 | 14.82 | 1528 | 12.27 |

The effect of the treatments on the CD properties of the webs illustrates the inventive effect. First, the pressing step without wetting generally reduced both CD tensile and CD stretch; however the reduction was slight and caused only a slight change in the CD slope. For example, for code 616 the CD tensile decreased from 752 grams per 3 inches to 658 grams per 3 inches for code 616 when the web was pressed.

Wetting alone (without pressing), on the other hand, increased both the CD stretch and the CD tensile, but only to a slight degree, which is reflected in the slight increase in CD slope. Again using code 616 as an example, the CD tensile increased from 752 grams per 3 inches to 819 grams per 3 inches due to the wetting alone.

However, when the web was subjected to both wetting and pressing, the CD slope increase was much greater than wetting or pressing alone. For example, the CD slope of code 616 increased from 3,795 grams per 3 inches for the control code 616-C to 9,328 grams per 3 inches for the wetted and pressed sample of code 616-7, an increase of 145 percent as a result of wetting and pressing.

This high slope was obtained while maintaining significant CD stretch in the sheet, approximately 10 percent CD stretch or more. While some portion of the CD slope increase was attributable to an increase in CD tensile (note the CD slope of the wetted only sample 616-5 having a higher CD tensile than the control was increased to 4,128 grams per 3 inches versus 3,795 grams per 3 inches for the control code 616-C) the increase cannot be accounted for by the tensile change alone.

One way to remove the influence of the tensile strength change from the comparison is to divide the CD slope by the CD tensile to obtain a slope/tensile ratio. In this case, the ratio of CD slope to CD tensile for samples that were both wetted and pressed is roughly 100 percent greater than that of the other samples. For example, for code 616, the ratios of CD slope to CD tensile are about 5 for the control, pressed only and wetted only samples (designated 616-C, 616-3 and 616-5 respectively). But the ratio of CD slope to CD tensile for inventive sample 616-7, which was wetted and pressed, is much larger—in fact about 100 percent larger at 10.75. This demonstrates that the increase in CD slope is not solely due to the increase in CD tensile. Further, because the CD stretch of code 616-7 is similar to that of the other pressed code 616-3, the affect of the process on CD stretch is also not the sole cause of the higher CD slope.

Similar results are apparent for all the other examples, regardless of fabric type and stretch level for the starting UCTAD base sheet. In all cases, the inventive treatment involving wetting and pressing of the sheet yielded a large increase in CD slope while maintaining a high CD stretch level.

The foregoing examples are intended to illustrate particular embodiments of the present disclosure without limiting the scope of the appended claims.

We claim:

1. A tissue web having a CD tensile of less than about 1,500 grams per 3 inches, a CD stretch greater than about 12 percent and a CD slope greater than about 9,000 grams per 3 inches.

2. The tissue of claim 1 wherein the CD tensile is from about 1,000 to about 1,300 grams per 3 inches.

3. The tissue of claim 1 wherein the CD stretch is greater than about 15 percent.

4. The tissue of claim 1 wherein the CD stretch is from about 12 to about 20 percent.

5. The tissue of claim 1 wherein the CD slope is from about 11,000 to about 15,000 grams per 3 inches.

6. The tissue of claim 1 wherein the CD tensile is from about 800 to about 1,500 grams per 3 inches and the CD slope is from about 9,000 to about 15,000 grams per 3 inches.

7. The tissue of claim 1 wherein the web is a throughdried web.

8. The tissue of claim 1 wherein the web is an uncreped throughdried web.

9. A tissue web having a ratio of CD slope to CD tensile greater than about 10 and CD Stretch greater than about 10 percent.

10. The tissue web of claim 9 having a CD Stretch greater than about 12 percent.

11. The tissue of claim 9 wherein the CD stretch is greater than about 15 percent.

12. The tissue of claim 9 wherein the CD tensile is from about 1,000 to about 1,300 grams per 3 inches.

13. The tissue of claim 9 wherein the CD stretch is from about 10 to about 20 percent.

14. The tissue of claim 9 wherein the CD slope is from about 11,000 to about 15,000 grams per 3 inches.

15. The tissue of claim 9 wherein the CD tensile is from about 1,000 to about 1,500 grams per 3 inches and the CD slope is from about 10,000 to about 15,000 grams per 3 inches.

* * * * *